US005343819A

United States Patent [19]

Charest

[11] Patent Number: 5,343,819

[45] Date of Patent: Sep. 6, 1994

[54] CORN FURNACE

[75] Inventor: Gilles Charest, Pointe-au-Chéne, Canada

[73] Assignee: Charest Deu Feu Inc., Canada

[21] Appl. No.: 130,365

[22] Filed: Oct. 1, 1993

[51] Int. Cl.[5] ..... F23B 7/00

[52] U.S. Cl. ..... 110/233; 110/110; 110/222; 241/186.5; 241/277; 241/600

[58] Field of Search ..... 110/110, 222; 241/277, 241/280, 600, 186.5; 414/190, 197; 126/58, 65, 66, 200

[56] References Cited

U.S. PATENT DOCUMENTS

| | | | |
|---|---|---|---|
| 4,669,396 | 6/1987 | Resh | 110/233 |
| 4,702,177 | 10/1987 | Nagisoko et al. | 110/110 |
| 5,001,993 | 3/1991 | Granalow | 110/233 |
| 5,285,738 | 2/1994 | Cullen | 110/233 |

*Primary Examiner*—Edward G. Favors
*Attorney, Agent, or Firm*—Austin R. Miller

[57] ABSTRACT

A corn furnace comprises a hopper for storing corn to be burned, and a combustion chamber in which corn is burned in a pot of fire to produce heat. An endless screw, supplying corn from the dispensing bottom of the hopper to the combustion chamber, comprises a lower proximate end for receiving corn from the hopper, a higher distal end for discharging corn in the combustion chamber through an inclined conduit, an elongate tubular member extending from the proximate to the distal end, and a generally helicoid blade rotatively mounted in the tubular member for conveying corn through that tubular member. The rotative helicoid blade is formed with a sharpened distal outer helical edge section. An air blower system supplies air to the distal end of endless screw to produce in the tubular member a flow of air in a direction opposite to the movement of the corn to remove from this corn dust and other impurities. To better sustain combustion of corn in the perforated pot of fire of the combustion chamber, air is supplied in the pot of fire through the inclined conduit, air is supplied in the pot of fire through the perforations thereof, and air is deflected from underneath the pot of fire toward an area of the combustion chamber above that pot.

13 Claims, 4 Drawing Sheets

CORN FURNACE

BACKGROUND OF THE INVENTION

1. Field of the Invention

The present invention relates to a corn furnace comprising a reliable endless screw for supplying corn to a combustion chamber, and a blower system both for removing dust and other impurities from the corn being supplied to the combustion chamber, and for efficiently ventilate the combustion chamber.

In the present specification and in the appended claims, the term "corn" is intended to designate the seeds of corn plants.

2. Brief Description of the Prior Art

Many corn furnaces are presently available on the market. However, these prior art furnaces present the following two drawbacks.

The conventional corn furnaces comprise a hopper to store corn, a combustion chamber in which corn is burned to produce heat, and an endless screw for continuously supplying corn from the dispensing bottom of the hopper to the combustion chamber to thereby ensure continuous operation of the furnace. A first drawback is that corn seeds often jam the helicoid rotative blade of the endless screw and stop operation of the furnace.

Another drawback of the conventional corn furnaces is that they require clean corn to operate properly.

OBJECTS OF THE INVENTION

An object of the present invention is therefore to eliminate the two above discussed drawbacks of the prior art.

Another object of the invention is to improve ventilation of the combustion chamber of a corn furnace.

SUMMARY OF THE INVENTION

More specifically, in accordance with a first aspect of the present invention, there is provided an endless screw for conveying seeds, comprising:

- a proximate end for receiving the seeds;
- a distal end for discharging these seeds;
- an elongate tubular member having a substantially cylindrical inner surface, and extending between the proximate and distal ends; and
- a generally helicoid blade rotatively mounted in the tubular member for conveying the seeds in the tubular member from the proximate end to the distal end of the endless screw, this helicoid blade having a distal substantially helical outer edge section that is sharpened to cut any seed squeezed between the sharpened helical edge section and the inner cylindrical surface of the tubular member and thereby prevent jamming of the helicoid blade in the tubular member.

In accordance with a second aspect of the present invention, there is provided a corn furnace comprising:

- hopper means for storing corn to be burned, the hopper means having a corn dispensing bottom;
- a combustion chamber in which corn is burned to produce heat; and
- an endless screw for supplying corn from the bottom of the hopper means to the combustion chamber, this endless screw comprising a proximate end for receiving corn from the bottom of the hopper means, a distal end in communication with the combustion chamber for discharging corn in the combustion chamber, an elongate tubular member having a substantially cylindrical inner surface and extending between the proximate and distal ends, and a substantially helicoid blade rotatively mounted in the tubular member for conveying corn in the tubular member from the proximate end to the distal end. In accordance with the invention, the helicoid blade has a distal substantially helical outer edge section that is sharpened to cut any corn squeezed between the sharpened helical edge section and the inner cylindrical surface of the tubular member and thereby prevent jamming of the helicoid blade in the tubular member.

Preferably, the elongate tubular member is formed with a radial opening to receive corn from the bottom of the hopper means therethrough, this radial opening being delimited by an edge of which at least a distal portion is sharpened to cooperate with the sharpened helical edge section of the blade to cut any corn squeezed between this sharpened helical edge section of the blade and the distal edge portion of the radial opening, and thereby prevent jamming of the helicoid blade in the tubular member.

According to a third aspect of the present invention, there is provided a corn furnace comprising hopper means for storing corn to be burned, these hopper means having a corn dispensing bottom, a combustion chamber in which corn is burned to produce heat, and conduit means for supplying corn from the bottom of the hopper means to the combustion chamber. These conduit means themselves comprise a proximate end for receiving corn from the dispensing bottom of the hopper means, a distal end in communication with the combustion chamber for discharging corn in the combustion chamber, and means for conveying corn from the proximate end to the distal end. An air blower system supplies air to the distal end of the conduit means to thereby produce a flow of air in the conduit means from the distal end to the proximate end whereby the air flows through the conduit means in a direction opposite to the movement of the corn to remove from the corn dust and other impurities and prevent the same to reach the combustion chamber. Of course, the dust and other impurities are discharged at the proximate end of the conduit means.

As the corn furnace remove dust and other impurities from the corn, less refined corn at lower cost can be used to operate the corn furnace according to the invention.

Preferably, the conduit means is an inclined endless screw of which the distal end is higher than the proximate end.

According to another advantageous embodiment of the invention, the combustion chamber comprises an exhaust conduit, and the corn furnace further comprises means for measuring pressure in this exhaust conduit and means for stopping the endless screw when the pressure measured in the exhaust conduit is higher than a predetermined pressure threshold. The air blower system may further comprise means for injecting fresh air in the exhaust conduit to reduce the temperature of the gas therein.

A fourth aspect of the invention relates to a corn furnace comprising: a combustion chamber provided with a receptacle therein, this receptacle comprising perforations and corn being burned in this receptacle to produce heat; means for supplying corn to the receptacle, these corn supplying means comprising conduit means through which corn is conveyed toward the receptacle; first means for supplying air in the receptacle through the conduit means; second means for supplying air in the receptacle through its perforations; and air deflecting means for deflecting air from the second supply means toward an area of the combustion chamber situated above the receptacle. Accordingly, ventilation of the combustion chamber is improved by supplying air for sustaining combustion of the corn in the receptacle through the above described conduit means, perforations, and air deflecting means.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
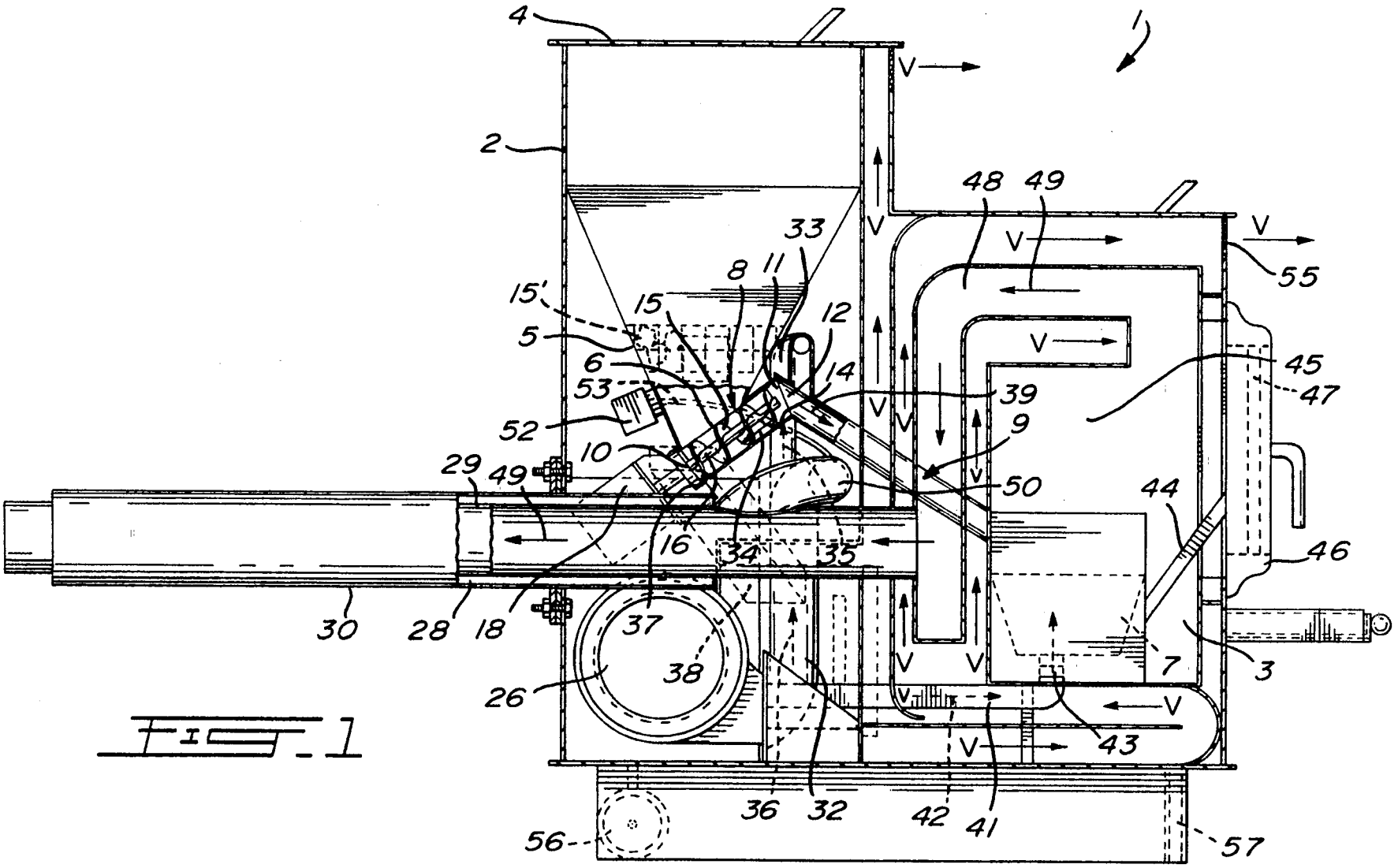
FIG. 1 is a side elevational, cross sectional view of the preferred embodiment of the corn furnace in accordance with the present invention.
Figure 2:
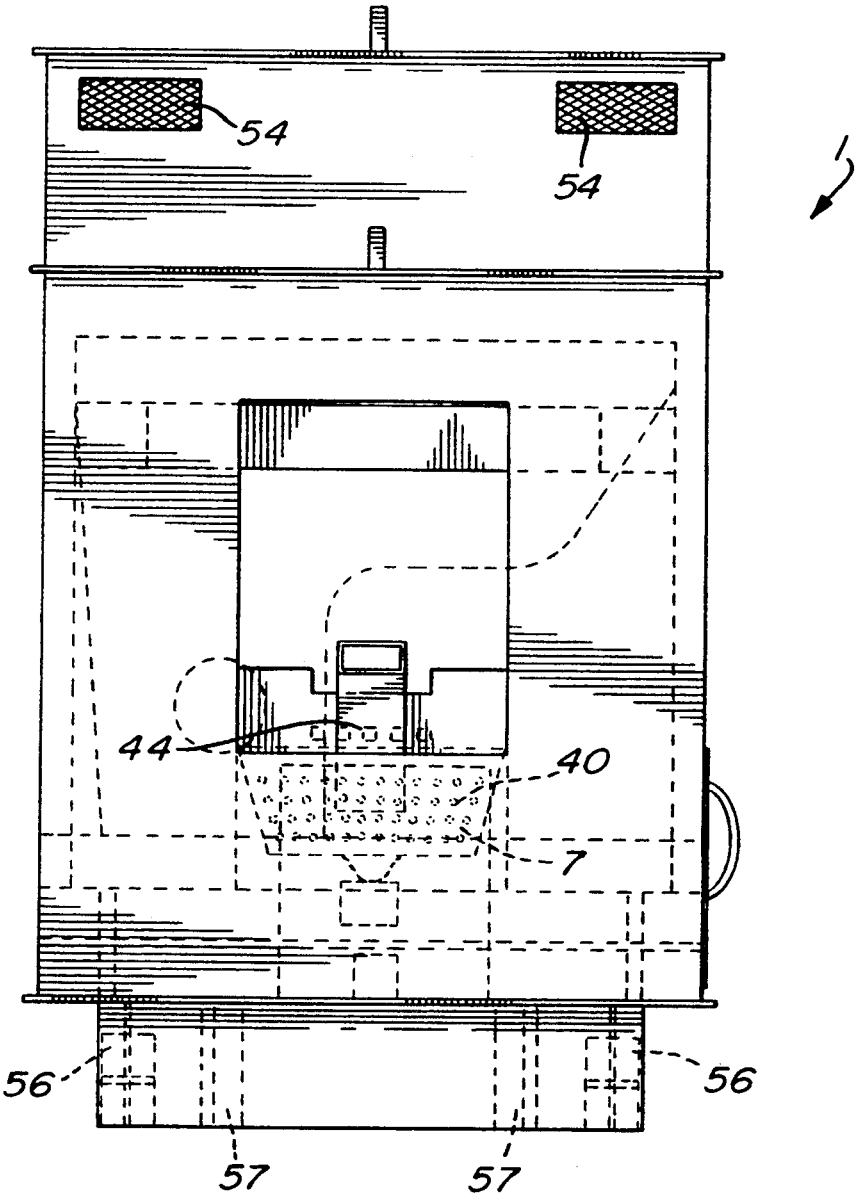
FIG. 2 is a front elevational view of the corn furnace of FIG. 1.
Figure 3:
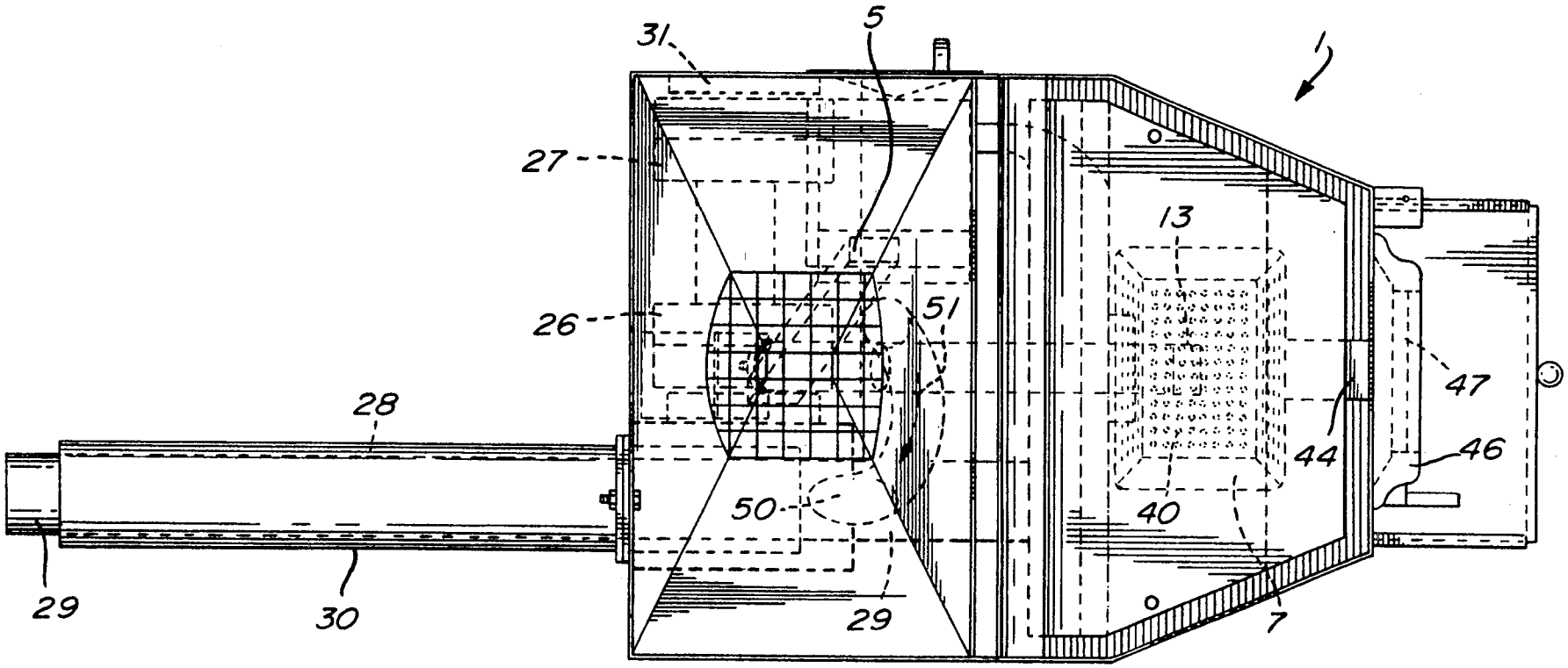
FIG. 3 is a top plan view of the corn furnace of FIGS. 1 and 2.

In FIGS. 1, 2 and 3 of the appended drawings, the preferred embodiment of the corn furnace in accordance with the present invention is generally identified by the reference 1.

The furnace 1 comprises a hopper 2 containing corn 15' to be burned in a combustion chamber 3 to produce heat.

The hopper 2 comprises an upper end preferably closed by means of a cover 4. As illustrated in FIG. 1, the corn dispensing bottom 5 of the hopper 2 has the shape of an inverted pyramid having four triangular converging walls to dispense corn 15' through an opening 6 of the hopper 2.

To supply corn in a pot of fire 7 installed in the lower portion of the combustion chamber 3, an endless screw 8 and an inclined conduit 9 are used.

The endless screw 8 comprises a proximate end 10 to receive corn from the dispensing bottom 5 of the hopper 2 through the opening 6, and a distal end 11. The distal end 11 is higher than the proximate end 10 and communicates with the pot of fire 7 through the conduit 9. The inclined conduit 9 has a higher end 12 connected to the distal end 11 of the endless screw 8, and a lower end 13 (FIG. 3) situated above the pot of fire 7. Accordingly, corn will be discharged from the distal end 11 in the pot of fire 7 of the combustion chamber 3 through the inclined conduit 9.

The endless screw 8 also comprises an elongate cylindrical tubular member 14 extending from the proximate end 10 to the distal end 11. This cylindrical tubular member 14 is formed with a radial opening 17 (FIG. 4) corresponding to the opening 6 of the corn dispensing bottom 5 of the hopper 2 to allow the proximate end 10 of the endless screw 8 to receive corn 15.

Figure 5:
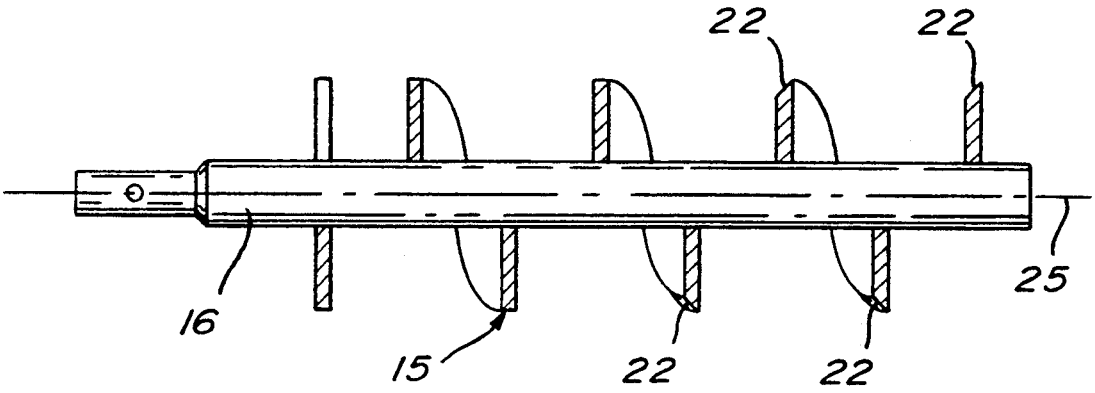
FIG. 5 illustrates an helicoid blade of the endless screw of FIG. 4.

The endless screw 8 further comprises a generally helicoid blade 15 (FIGS. 1 and 5) mounted on a central longitudinal shaft 16 rotated by means of an electric motor 18 about a longitudinal central rotation axis 25 (FIG. 5). As known to those of ordinary skill in the art, rotation of the helicoid blade 15 will convey corn in the tubular member 14 from the proximate end 10 to the distal end 11 of the endless screw 8.

To prevent jamming of helicoid blade 15 in the tubular member 14, that helicoid blade 15 comprises a distal substantially helical outer edge section 22 that is sharpened (to form a triangular edge) to cut any corn squeezed between the sharpened helical edge section 22 and the inner cylindrical surface of the tubular member 14 and thereby prevent jamming of the helicoid blade 15 in the tubular member.

Also, the radial opening 17 (FIG. 4) through which corn 15' is received from the bottom 5 of the hopper 2 is delimited by an edge of which at least the distal portion 23 is sharpened to form a triangular edge, which cooperates with the sharpened helical edge section 22 of the blade 15 to cut any seed squeezed between said sharpened helical edge section 22 and the distal edge portion 23.

According to an advantageous embodiment, the diameter of the helicoid blade 15 is 1.375 inch and the distance between successive turns of the blade 15 is 1 inch.

The electric motor 18 of the endless screw 8 is preferably operated through a timer (not shown) to control the quantity of corn supplied to the combustion chamber 3, and thereby control the quantity of heat produced by the furnace 1. The rotational speed of the motor 18 can also be adjusted and/or controlled for that purpose.

The corn furnace 1 further comprises a pair of blowers 26 and 27 (FIG. 3). Blower 26 sucks fresh air from outdoors through an annular horizontal conduit 28 delimited by the outer cylindrical surface of an horizontal exhaust conduit 29 and the inner cylindrical surface of an horizontal outer conduit 30. Outer conduit 30 has a larger diameter than the exhaust conduit 29 and is mounted coaxial therewith. As can be appreciated by those of ordinary skill in the art, the conduits 29 and 30 pass through a hole made in an outside wall of, for example, a house to reach the exterior of that house.

Blower 27 sucks air from the inside through an air intake 31 (FIGS. 2 and 3) of the furnace 1 and produces a flow of air that adds to the flow of air produced by the first blower 26.

It should be pointed out here that the fresh air sucked by the blower 26 through the annular conduit 28 is heated by the hot gases exhausted through the conduit 29, by heat exchange through the wall of that exhaust conduit 29.

Figure 4:
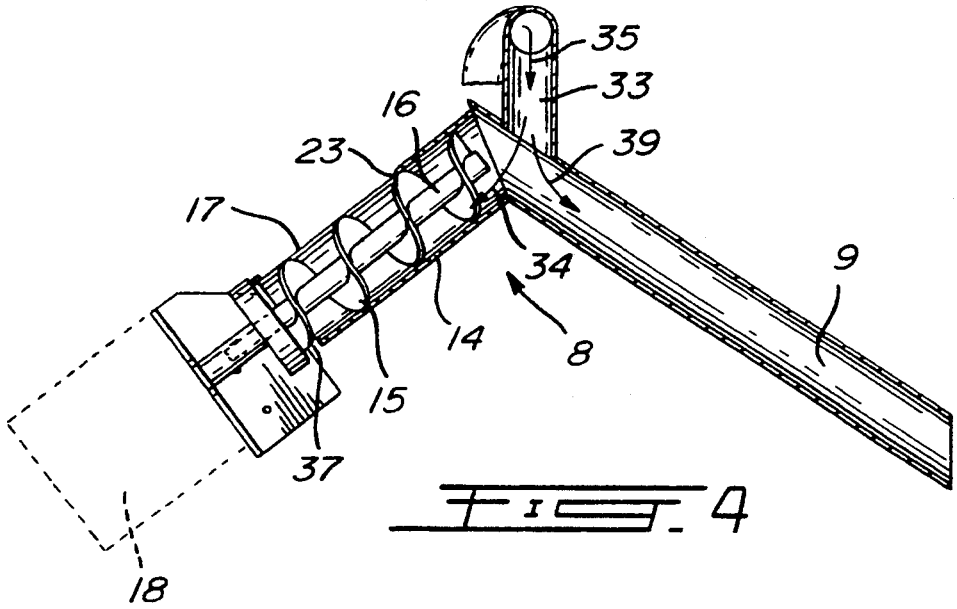
FIG. 4 is a side elevational view of an endless screw of the corn furnace of FIGS. 1, 2 and 3.

Air from the blowers 26 and 27 is supplied to the distal end 11 of the endless screw 8 through a first vertical conduit 32 of larger diameter (see arrow 36 of FIG. 1), and a second vertical conduit 33 of smaller diameter (see arrow 35 of FIGS. 1 and 4). The upper portion of the conduit 33 has the shape of an inverted "U" to enable connection thereof at the top of the intersection of the endless screw distal end 11 and the higher conduit end 12. Air will therefore flow through the cylindrical tubular member 14 from the distal end 11 to the proximate end 10 (see arrow 34 of FIGS. 1 and 4).

The flow 34 of air through the elongate tubular member 14 in a direction opposite to the movement of the corn will remove from this corn dust and other impurities to thereby prevent these dust and other impurities to reach the combustion chamber. Less refined corn at lower cost can therefore be used to operate the corn furnace 1.

The dust and other impurities removed from the corn discharge at the proximate end 10 of the endless screw 8 through a hole 37 made in the underside of the elongate cylindrical member 14. An inclined conduit 38, rectangular in cross section, guides the discharged dust and other impurities from the hole 37 to a dust collection drawer (not shown).

Air from the blowers 26 and 27 is also supplied to the higher end 12 of the inclined conduit 9 through the vertical conduits 32 (arrow 36) and 33 (arrow 35). Air will therefore flow through the inclined conduit 9 from its higher end 12 to the lower end 13 (see arrow 39 of FIGS. 1 and 4). The flow of air 39 in the inclined conduit 9 will be supplied in the pot of fire 7 and will therefore contribute to sustain combustion of corn in this pot of fire 7, which is installed in the lower portion of the combustion chamber 3. Escape of smoke and/or combustion gases from the combustion chamber 3 through the inclined conduit 9 is also prevented by the flow of air 39.

The pot of fire 7 is a receptacle in which corn is burned to produce heat. As illustrated in FIGS. 2 and 3 the pot of fire 7, in particular the bottom thereof, comprises perforations such as 40. To contribute to sustain combustion of corn in the pot of fire 7, air from the blowers 26 and 27 is supplied in the combustion chamber 3 underneath the pot of fire 7 through an horizontal conduit 41 (see arrow 42). Of course, air from the conduit 41 is supplied to the corn burning in the pot of fire 7 through the perforations 40. The end of the horizontal conduit 41 adjacent the combustion chamber 3 is bent at right angle to form a vertical conduit section 43.

Air supplied in the combustion chamber 3 through the conduit 41 is deflected by an air deflector 44 to supply with the deflected air the upper portion 45 of the combustion chamber 3, above the pot of fire 7, so as to oxygenate this upper chamber portion 45 and thereby contribute to sustain combustion of corn in the pot of fire 7. As illustrated in FIGS. 2 and 3, the air deflector 44 is formed by a tilted rectangular metal plate.

One of ordinary skill in the art will appreciate that ventilation of the combustion chamber 3 is improved by supplying air for sustaining combustion of the corn in the pot of fire 7 through the inclined conduit 9, the horizontal conduit 41 and the air deflector 44.

The combustion chamber 3 comprises a door 46 itself provided with a window 47. The deflector 44 deflects air from the conduit 41 toward the inner surface of the window 47 whereby a secondary function of the deflector 44 is to keep this window 47 clean.

Smoke and/or combustion gases produced by combustion of corn in the pot of fire 7 escape from the chamber 3 through an L-shaped extension 48 of the combustion chamber and the horizontal exhaust conduit 29 (see arrows 49). L-shaped extension 48 constitutes an extension of the top of the combustion chamber 3 toward the bottom of the furnace 1. L-shaped extension 48 also extends widthwise across the corn furnace. One end of the exhaust conduit 29 is connected to the lower portion of the L-shaped extension 48 and the other end thereof is located, as described in the foregoing description, outdoors to allow the smoke and/or combustion gases to escape to the open air.

Efficient burning of the corn in the pot of fire 7 of the furnace 1 in accordance with the present invention causes too high a temperature of the smoke and/or combustion gases in the exhaust conduit 29. To reduce the temperature to an acceptable level, air from the blowers 26 and 27 is injected in the exhaust conduit 29 through the vertical conduit 32 (arrow 36 of FIG. 1) and an arcuate conduit 50 (arrow 51 of FIG. 3) interposed between the conduits 32 and 29.

When exhaust conduit 29 becomes obstructed for any reason, the pressure in the exhaust conduit 29 and therefore in the arcuate conduit 50 will raise. A pressure switch 52 connected to the conduit 50 through a small pipe 53 will sense pressure in the exhaust conduit 29 and as soon as this pressure oversteps a first predetermined threshold, will deenergize the electric motor 18 to stop the endless screw 8 and therefore interrupt supply of corn to the pot of fire 7. The motor will be energized again only if the sensed pressure lowers to a second predetermined threshold lower than the first one.

Finally, ducts and/or passages are formed around the combustion chamber 3 and the extension 48. Air from the blowers 26 and 27 flows (see arrows "v" in FIG. 1) in these ducts and/or passages and is heated by heat exchange through the walls of the combustion chamber 3 and extension 48, made of refractory stainless steel. Heated air is supplied to the area in which the furnace 1 is located through air outlets 54 (FIG. 1) and 55 (FIG. 2). Heated air can be conveyed toward a remote area to be heated through ducts (not shown) connected in the region of the outlet 54 and 55. This type of ventilation is well known to those of ordinary skill in the art and therefore will not be further described in the present specification.

The furnace 1 can be mounted on wheels 56 and posts 57 to facilitate displacement and installation thereof.

Finally, lighting and cleaning of the furnace 1 are conventional. The furnace is stopped by stopping the endless screw 8, which stops supply of corn.

Although the present invention has been described hereinabove by way of a preferred embodiment thereof, this embodiment can be modified at will, within the scope of the appended claims, without departing from the spirit and nature of the subject invention.

What is claimed is:

1. An endless screw for conveying seeds, comprising:

a proximate end for receiving said seeds;

a distal end for discharging said seeds;

an elongate tubular member having a substantially cylindrical inner surface, and extending between said proximate and distal ends; and a generally helicoid blade rotatively mounted in the tubular member for conveying the seeds in said tubular member from the proximate end to the distal end of the endless screw, said helicoid blade having a distal substantially helical outer edge section that is sharpened to cut any seed squeezed between the sharpened helical edge section and the inner cylindrical surface of the tubular member and thereby prevent jamming of the helicoid blade in the tubular member.

2. An endless screw as recited in claim 1, in which said elongate tubular member is formed with a radial opening to receive corn therethrough, said radial opening being delimited by an edge of which at least a distal portion is sharpened to cooperate with the sharpened helical edge section of the blade to cut any seed squeezed between said sharpened helical edge section of the blade and the distal edge portion of the radial opening, and thereby prevent jamming of the helicoid blade in the tubular member.

3. A corn furnace comprising:

hopper means for storing corn to be burned, said hopper means having a corn dispensing bottom;

a combustion chamber in which corn is burned to produce heat; and an endless screw for supplying corn from the bottom of said hopper means to the combustion chamber, said endless screw comprising a proximate end for receiving corn from said bottom of the hopper means, a distal end in communication with the combustion chamber for discharging corn in said combustion chamber, an elongate tubular member having a substantially cylindrical inner surface and extending between said proximate and distal ends, and a substantially helicoid blade rotatively mounted in the tubular member for conveying corn in said tubular member from said proximate end to said distal end;

the improvement therein comprising said helicoid blade having a distal substantially helical outer edge section that is sharpened to cut any corn squeezed between the sharpened helical edge section and the inner cylindrical surface of the tubular member and thereby prevent jamming of the helicoid blade in the tubular member.

4. A corn furnace as recited in claim 3, in which said elongate tubular member is formed with a radial opening to receive corn from the bottom of the hopper means therethrough, said radial opening being delimited by an edge of which at least a distal portion is sharpened to cooperate with the sharpened helical edge section of the blade to cut any corn squeezed between said sharpened helical edge section of the blade and the distal edge portion of the radial opening, and thereby prevent jamming of the helicoid blade in the tubular member.

5. A corn furnace comprising:

hopper means for storing corn to be burned, said hopper means having a corn dispensing bottom;

a combustion chamber in which corn is burned to produce heat;

conduit means for supplying corn from said bottom of the hopper means to the combustion chamber, said conduit means comprising a proximate end for receiving corn from said dispensing bottom of the hopper means, a distal end in communication with the combustion chamber for discharging corn in said combustion chamber, and means for conveying corn from said proximate end to said distal end; and an air blower system for supplying air to said distal end of the conduit means to thereby produce a flow of air in said conduit means from said distal end to said proximate end whereby said air flows through the conduit means in a direction opposite to the movement of the corn to remove from said corn dust and other impurities and prevent said dust and other impurities to reach the combustion chamber, said dust and other impurities being discharged at said proximate end of the conduit means.

6. A corn furnace as recited in claim 5, wherein said combustion chamber comprises an exhaust conduit, said furnace further comprising means for measuring pressure in said exhaust conduit and means for stopping said corn conveying means when the pressure measured in said exhaust conduit is higher than a predetermined pressure threshold.

7. A corn furnace as recited in claim 6, wherein said air blower system comprises means for injecting fresh air in said exhaust conduit for reducing the temperature of smoke and/or combustion gases present in said exhaust conduit.

8. A corn furnace as recited in claim 5, wherein said conduit means is inclined and wherein said distal end is higher than said proximate end.

9. A corn furnace as recited in claim 5, in which:

said conduit means is an endless screw;

said endless screw is inclined; and the distal end of the endless screw is higher than the proximate end of said endless screw.

10. A corn furnace as recited in claim 9, wherein said combustion chamber comprises an exhaust conduit, said furnace further comprising means for measuring pressure in said exhaust conduit and means for stopping said endless screw when the pressure measured in said exhaust conduit is higher than a predetermined pressure threshold.

11. A corn furnace as recited in claim 9, in which:

said distal end of the endless screw communicates with the combustion chamber through an inclined conduit having a higher end connected to said distal end of the endless screw and a lower end connected to the combustion chamber; and said air blower system comprises means for supplying air to the higher end of said inclined conduit to thereby establish a flow of air from said higher end to said lower end of the inclined conduit whereby escape of smoke and/or combustion gases from said chamber through said inclined conduit is prevented.

12. A corn furnace comprising:

a combustion chamber provided with a receptacle therein, said receptacle comprising perforations and corn being burned in said receptacle to produce heat;

means for supplying corn to said receptacle, said corn supplying means comprising conduit means through which corn is conveyed toward said receptacle;

first means for supplying air in the receptacle through said conduit means;

second means for supplying air in said receptacle through said perforations; and air deflecting means for deflecting air from said second supply means toward an area of the combustion chamber situated above the receptacle;

whereby, in operation, air for sustaining combustion of the corn in the receptacle is supplied through said conduit means, said perforations, and said deflecting means.

13. A corn furnace as recited in claim 12, wherein said combustion chamber comprises a door with a window having an inner surface, and wherein said air deflecting means comprises means for deflecting air toward the inner surface of said window.

* * * * *